United States Patent [19]

Bjorklund et al.

[11] 3,930,932

[45] Jan. 6, 1976

[54] PROCESS FOR SIZING CELLULOSE FIBRE CONTAINING MATERIAL

[75] Inventors: James Axel Christer Björklund, Saltsjo-Boo; Karin Ulla Elisabet Helmer, Solna, both of Sweden

[73] Assignee: Kemanord AB, Stockholm, Sweden

[22] Filed: Jan. 31, 1974

[21] Appl. No.: 438,317

[30] Foreign Application Priority Data

Jan. 31, 1973 Sweden ..... 7301319

[52] U.S. Cl. ..... 162/158; 8/181; 8/192; 252/312; 427/395

[51] Int. Cl.[2] ..... D21D 3/00

[58] Field of Search ..... 162/158, 182, 179; 8/120, 8/115.6, 181, 192, 187; 260/544 C, 544 Y, 463; 427/395; 252/310, 311, 312

[56] References Cited

UNITED STATES PATENTS

| | | | |
|---|---|---|---|
| 3,008,978 | 11/1961 | Brotherton et al. | 260/463 |
| 3,492,081 | 1/1970 | Morak | 162/157 C |
| 3,499,824 | 3/1970 | Strazdins et al. | 162/182 |
| 3,501,523 | 3/1970 | Sayigh et al. | 260/544 C |

*Primary Examiner*—S. Leon Bashore
*Assistant Examiner*—Peter Chin
*Attorney, Agent, or Firm*—Fred Philpitt

[57] ABSTRACT

The present invention relates to a process for sizing cellulose fibers or cellulose fiber containing materials and a composition for carrying out the process. According to the process the time for developing full sizing effect of ketene dimers and carbamoyl chlorides is reduced by carrying out sizing in the presence of a chloroformate or an isocyanate. The composition for carrying out the process comprises of a paper sizing composition containing the sizing agents mentioned above in combination with a chloroformate or an isocyanate.

2 Claims, No Drawings

PROCESS FOR SIZING CELLULOSE FIBRE CONTAINING MATERIAL

BACKGROUND

It is previously known that cellulose fiber containing materials are sized by ketene dimers or carbamoyl chlorides (e.g., Swedish Pat. Nos. 177,927 or 356,088). The hydrophobic effect is obtained by reaction of the ketene dimer group or the carbamoyl chloride group with the free hydroxyl groups of the cellulose fibers, whereby an organic bond is obtained between the cellulose molecule and the sizing agent. In addition to the cellulose reactive group, the sizing agent also contains a hydrocarbon group with hydrophobic properties, and after completion of the reaction, cellulose fibers with water-repellent properties are obtained.

A suitable process for producing paper with hydrophobic properties consists in adding a dispersion of the sizing agent to the fibers in the stock, the dispersion having such properties that the dispersed particles of the sizing agent are attracted to the cellulose fibers. After removal of water from the fiber suspension on the endless wire, the wet sheet is passed through the press and drier section, whereby the dispersion is broken and the sizing agent gets into contact with the fibers. In the sizing process it is assumed that the sizing agent must first melt, spreading over the fibers and then reacting with the hydroxyl groups. The high speed of paper making machines used today results in about a 30 second stay in the drier section, where the average temperature in the paper sheet is 70° – 75°C. This means that the ketene dimer or the carbamoyl chloride does not get time to react completely with the cellulose fibers in the paper making machine, with the result that the paper leaves the machine in a substantially unsized condition. The hydrophobic effect is developed latter, partly on the tambour, partly during a following storage.

However, it is desirable to obtain a more rapid curing so that the paper will have a high sizing when it leaves the paper making machine. This is of importance when it is desired to change the dosage of additives in paper making in such a way that the hydrophobic properties of the produced paper can be evaluated immediately after leaving the machine. Moreover, storage space can be considerably reduced, which space is at present necessary for the above-mentioned aftercuring to take place. In the cases when it is desired in paper making to coat the paper in line, it is likewise necessary that a certain degree of sizing has already been developed in the machine.

It has been suggested in British Pat. No. 1,172,898 to accelerate the curing time of ketene dimers by adding minor amounts of a hydrophobic acyl compound such as fatty acids and derivatives thereof. These compounds also act as extenders for the ketene dimer. However, using stearic acid in combination with ketene dimers requires a relatively high temperature (approximately 100°C) to accelerate the curing, which temperature cannot be obtained in a conventional drier section of a paper making machine.

THE PRESENT INVENTION

According to our invention it has surprisingly been found that the curing of ketene dimers and carbamoyl chlorides is considerably accelerated — even at relatively low curing temperatures — if a chloroformate or an isocyanate is present during the curing. As is evident from the examples which follow, this effect is superior to that obtained with the acyl compounds previously known.

According to our invention cellulose fibers are sized by being brought into contact with a sizing agent containing ketene dimer or carbamoyl chloride, whereby the sizing is carried out in the presence of a chloroformate or isocyanate. The time for developing full sizing effect will then be reduced in the order of 50%. The effect of the chloroformate and the isocyanate respectively seems to be of catalytic character, as the total sizing effect is not appreciably influenced.

The invention also relates to a paper sizing composition comprising a sizing agent consisting of ketene dimer or carbamoyl chloride in combination with a chloroformate or an isocyanate. A paper sizing composition according to our invention comprises of a water dispersion of the active components, optionally together with at least one emulsifier known per se.

Any material containing cellulose fibers can be sized according to our process. Thus the process can be carried out by addition of the components to a water suspension of cellulose fibers. Condensed forms of cellulose fibers, such as paper, cardboard, board, particle board, etc. can likewise be sized, e.g., by submerging the material into a water dispersion or a solution of our components. The sizing system of our invention can also be suitably formulated for application to a condensed material containing cellulose fibers by surface coating. Of course the material containing cellulose fibers need not consist of merely cellulose fibers, since it can for instance occur in admixture with other materials, such as semi-synthetic paper containing plastics.

A paper sizing composition according to our invention can in known manner contain emulsifiers to form stable water dispersions, such as emulsifiers of anionic, cationic or non-ionic character or a mixture thereof. The amount of emulsifier is selected in a known manner with respect to the components present, the dry content of the dispersion, etc. Usually an amount of emulsifier is used exceeding 1% by weight based on the components to be dispersed.

For instance, upon addition to a water suspension of the fibers the included components are emulsified with a cationic emulsifier to a stable water dispersion which is added to the stock before dewatering the fibers. As examples of suitable cationic dispersing agents there can be mentioned polyethylene imine, polyalkylene polyamide resins, cationic starch, etc.

It is essential according to our invention that the curing of the sizing agents is carried out in the presence of a chloroformate or an isocyanate, and accordingly any known methods for applying the active components are possible. Thus, a dispersion of the sizing agent and a dispersion of the chloroformate and the isocyanate respectively can for instance be added separately to the stock. Another possible way of carrying out our process is by adding a dispersion of the sizing agent to the stock and later applying a solution or dispersion of the chloroformate or the isocyanate during the dewatering of the fiber web.

The chloroformates and isocyanates used according to our invention preferably consist of compounds which are substituted with hydrophobic, organic groups. Such compounds are known per se as sizing agents for cellulose fibers, but we discovered that they further seem to have a catalyzing effect on ketene dimers and carbamoyl chlorides respectively. This is evident from the fact that the time for obtaining full curing is reduced by using very small amounts of the compounds, in fact such small amounts that these are not enough per se to obtain a hydrophobic effect. Moreover, the total hydrophobic effect is not substantially improved in carrying out the process according to our invention. Only the time for obtaining a maximum hydrophobic effect with the sizing agent in the form of ketene dimer or carbamoyl chloride is reduced. The hydrophobic organic group of the chloroformate and the isocyanate respectively, e.g., such as are described hereinafter for ketene dimers or carbamoyl chlorides, can be selected from among those groups which are well-known for having a hydrophobic effect. When compositions according to our invention are to be prepared, hydrophobic groups similar to those of the ketene dimer and the carbamoyl chloride respectively are preferably selected. The hydrophobic groups suitably consist of alkyl chains containing 8 – 40 carbon atoms, and preferably 12 – 20 carbon atoms.

The amount of chloroformate and isocyanate used in combination with the sizing agent should exceed 0.5% by weight based on the weight of the sizing agent. Although the upper limit is not critical, the catalyzing effect on the curing seems to decrease when the amount exceeds 100%. For economical reasons a ratio of sizing agent to chloroformate or isocyanate is selected within the range of about 1:0.05 – 1:1, and preferably from about 1:0.1 – 1:0.7.

The sizing agents, whose effect is enhanced in carrying out our process, consists of ketene dimers or carbamoyl chlorides. These compounds are well-known as sizing agents for cellulose fibers and contain in addition to the reactive group an organic substituent having hydrophobic properties. Organic hydrophobic hydrocarbon groups which have been found to be useful for sizing of cellulose fiber materials, are those in which the hydrophobic group is a higher alkyl having at least about 8 carbon atoms, e.g., decyl, undecyl, dodecyl, tridecyl, tetradecyl, pentadecyl, hexadecyl, heptadecyl, octadecyl, tetracosyl and pentacosyl and higher alkyl groups up to about 40 carbon atoms, if desired, although those having about 12 – 30 carbon atoms are preferred; the corresponding alkenyl groups having between about 8 and about 40 carbon atoms, among which for instance can be mentioned decenyl, tridecenyl, heptadecenyl, octadecenyl, eicosenyl, tricosenyl, etc.; aralkyl, alkaryl and alkyl substituted cycloalkyl having at least about 8 carbon atoms, e.g., 4-tert. butylphenyl, octylphenyl, nonylphenyl, dodecylphenyl, tridecylphenyl, pentadecylphenyl, octadecylphenyl, eicosylphenyl, nonylcyclopropyl, dodecylcyclobutyl, tridecylcyclopentyl, tetradecylcyclohexyl, pentadecylcycloheptyl, octadecylcylohexyl etc. and any of these alkyl, alkenyl, alkaryl and alkylcycloalkyl groups containing non-disturbing, inert substituents. Among inert substituents can be mentioned carboalkoxy, alkyloxy, aryloxy, arylalkyloxy, keto (carbonyl), tert. amide groups, etc. Among examples of radicals, which should not occur to any large extent in the hydrophobic group, hydroxyl groups, primary and secondary amino groups, amide groups containing amide hydrogen and carboxyl groups or other acid groups can be mentioned. It is obvious to persons skilled in this art which groups can be used in these compounds if undesired side reactions are to be avoided. Usually the hydrophobic substituent consists of an alkyl group containing 8 – 40 carbon atoms, preferably 12 – 20 carbon atoms. The carbamoyl chloride can be substituted with one or two hydrophobic groups. In the cases when monosubstituted carbamoyl chlorides are used the other substituent preferably consists of a lower alkyl group.

The amount of sizing composition added to the cellulose fiber containing material according to our invention can vary within wide limits and depends on different factors, such as application technique, the special cellulose fiber containing material to be sized, e.g., the quality of the pulp, etc., pH at stock addition, amount and type of emulsifier, etc. At stock addition or surface sizing the compositions are usually added in an amount exceeding 0.01% by weight based on the dry fibers. The upper limit is not really critical but is primarily governed by economical considerations. An addition of our compositions within the range of from 0.05 to 5% by weight, preferably 0.05 to 1% by weight based on the dry fibers is preferably chosen. Our sizing composition is intended to include the combination of the sizing agent and chloroformate or isocyanate, as well as optionally occurring emulsifier, etc.

The effect of accelerating the curing according to our invention does not seem to be influenced by other conventional additives used in paper making or in surface coating of paper. Thus the fiber suspension or the condensed fibers can in a known manner contain other additives used in paper making, e.g., fillers, alum, retention agents, anti-foam agents, flocculation agents, etc.

The invention will be described in more detail in the following illustrative examples, which, however, are not intended to limit our invention. Percentages and parts are by weight unless otherwise indicated.

EXAMPLE 1

Strips of unsized paper sheets were submerged into toluene solutions containing 40 – 60 mg of distearyl carbamoyl chloride per 100 ml of toluene as sizing agent and with varying amounts of cetyl chloroformate and stearyl isocyanate respectively, as is evident from the tables below. After submerging, the strips were dried at room temperature. Then the strips were cured in heating chambers at 40°C and taken out after different periods of time for examination of the curing time. This was determined by means of an ink (floatation) test in such a way that the test strips were placed on a water bath at pH 8 containing a dyestuff. The specimens were considered as sized when no strike-through was obtained after 10 min. duration of stay on the water surface. The results appear from the following tables.

40 mg of distearyl carbamoyl chloride per 100 ml of toluene.

| Cetyl chloroformate (mg/100 ml of toluene) | 0 | 5 | 10 | 15 | 20 |
|---|---|---|---|---|---|
| Curing time (min) | 125 | 95 | 81 | 69 | 52 |

60 mg of distearyl carbamoyl chloride per 100 ml of toluene.

| Cetyl chloroformate (mg/100 ml of toluene) | 0 | 5 | 10 | 15 | 30 |
|---|---|---|---|---|---|
| Curing time (min) | 58 | 37 | 29 | 26 | 31 |

50 mg of distearyl carbamoyl chloride per 100 ml of toluene.

| Stearyl isocyanate (mg/100 ml of toluene) | 0 | 1 | 2 | 8 | 20 |
|---|---|---|---|---|---|
| Curing time (min) | 75 | 65 | 51 | 8 | 5 |

As is evident from the above tables, that time for complete curing was considerably reduced by small added amounts of chloroformate or isocyanate.

EXAMPLE 2

The curing time of sizing systems containing ketene dimer as sizing agent and chloroformate or isocyanate as a catalyzing component was evaluated in the same way as described in Example 1. The results are shown in the following tables.

60 mg of distearyl ketene dimer per 100 ml of toluene.

| Cetyl chloroformate (mg/100 ml of toluene) | 0 | 5 | 10 | 15 | 20 | 25 | 30 |
|---|---|---|---|---|---|---|---|
| Curing time (min) | 100 | 76 | 68 | 60 | 56 | 53 | 51 |

70 mg of distearyl ketene dimer per 100 ml of toluene.

| Cetyl chloroformate (mg/100 ml of toluene) | 0 | 10 | 20 | 25 | 30 |
|---|---|---|---|---|---|
| Curing time | 90 | 80 | 27 | 44 | 45 |

50 mg of distearyl ketene dimer per 100 ml of toluene.

| Stearyl isocyanate (mg/100 ml of toluene) | 0 | 2 | 4 | 6 | 8 | 10 |
|---|---|---|---|---|---|---|
| Curing time (min) | 110 | 100 | 22 | 20 | 10 | 7 |

As is evident from the above tables, the time for complete curing was considerably reduced by the addition of small amounts of chloroformate or isocyanate.

EXAMPLE 3

Water dispersions of methyl stearyl carbamoyl chloride and distearyl carbamoyl chloride containing varying amounts of cetyl chloroformate or stearyl isocyanate were prepared by melting the components at 40°C, after which water having the same temperature was added under agitation in a Turrax agitator for 3 min. The water amounts were adapted so that dispersions of 2% were obtained, which were rapidly cooled on ice baths, resulting in a stable dispersion. The dispersions obtained were then diluted to different dry contents. Test specimens of unsized strips of paper were submerged into the aqueous dispersions. The impregnated strips were cured in drying chambers at 60°C and the time for curing was determined according to the ink (flotation) test, as described above. The results appear from the tables below.

| Curing at 60°C<br>Sizing agent composition | Curing time (min)<br>% by weight of sizing agent composition based on dry fibers<br>0.2 | 0.1 |
|---|---|---|
| Methylstearylcarbamoylchloride | 42 | 40 |
| Methylstearylcarbamoylchloride Stearylisocyanate (9:1) | 17 | 29 |
| Methylstearylcarbamoylchloride Cetylchloroformate (9.5:0.5) | 23 | 22 |
| Distearylcarbamoylchloride | 18 | 20 |
| Distearylcarbamoylchoride Stearylisocyanate (9:1) | 3 | 7 |
| Distearylcarbamoylchloride Cetylchloroformate (9:1) | 5 | 10 |

EXAMPLE 4

Sheets having a surface weight of 75 g/m² were formed in a laboratory sheet machine from bleached sulphate pulp beaten to about 22° SR. In sheeting water dispersions of sizing compositions corresponding to a dry content of 0.07 and 0.1% by weight based on dry fibers were added. Sheeting was carried out at a pulp concentration of 0.2% by weight and a pH of 7. After sheeting the sheets were pressed for 4 min. at a pressure of 5 kg/cm² and dried in a drying chamber for 60 min. at 60°C, after which they hung at room temperature for further curing. The sizing effect was determined according to SCAN:P 12:64 at different points of time to learn how far the curing process had proceeded. The results appear from the tables below.

At the tests the following sizing systems were used (The statements of amounts relate to % by weight based on dry fibers):

| | | | | | |
|---|---|---|---|---|---|
| A: | Distearylcarbamoyl-chloride | 0.07 | D: | Distearylcarbamoyl-chloride | 0.10 |
| B: | Distearylcarbamoyl-chloride | 0.063 | E: | Distearylcarbamoyl-chloride | 0.09 |
| | Cetylchloroformate | 0.007 | | Cetylchloroformate | 0.01 |
| C: | Distearylcarbamoyl-chloride | 0.063 | F: | Distearylcarbamoyl-chloride | 0.09 |
| | Stearylisocyanate | 0.007 | | Stearylisocyanate | 0.01 |

| Sizing system | Cobb$_{60}$ g/m² Curing time 1 h | 24 h | 7 days | 12 days |
|---|---|---|---|---|
| A | 42 | 36 | 30 | 27 |
| B | 31 | 28 | 24 | 23 |
| C | 28 | 25 | 21 | 20 |
| D | 41 | 33 | 27 | 25 |
| E | 32 | 27 | 21 | 20 |
| F | 27 | 22 | 19 | 18 |

After 12 days the tests were interrupted, and the specimens were finally cured in drying chambers at 105°C, substantially the same Cobb number being obtained for A, B and C respectively D, E and F.

As is evident from the table the sizing degree at room temperature was developed considerably more rapidly when using systems according to our invention.

We intend to claim the priority benefits of our Swedish application No. 73/01359-5 and the disclosure of this Swedish Application is incorporated herein by reference (an English translation thereof being filed herewith).

We claim:

1. In the known process for sizing cellulose fibers in aqueous suspension or for sizing paper products containing cellulose fibers which comprises treating the cellulose fibers with an amount of a carbamoyl chloride which is sufficient to effect sizing of the cellulose fibers, said carbamoyl chloride having the general formula

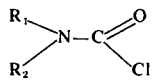

wherein $R_1$ is an organic hydrophobic group and $R_2$ is a lower alkyl group or has the same meaning as $R_1$, the improvement which comprises combining with the carbamoyl chloride a material selected from the group consisting of alkyl chloroformates or alkyl isocyanates, wherein the alkyl chain in each instance contains 8 – 40 carbon atoms, the ratio of the carbamoyl chloride to chloroformate or the ratio of the carbamoyl chloride to the isocyanate being within the range of from about 1:0.5 to 1:1.

2. A composition for sizing cellulose fibers in aqueous suspension or paper products containing cellulose fibers comprising a water dispersion of a. an emulsifier in an emulsifying amount, b. a carbamoyl chloride as sizing agent, and c. a material selected from the group consisting of alkyl chloroformates or alkyl isocyanates, wherein the alkyl chain in each instance contains 8–40 carbon atoms and where the ratio of carbamoyl chloride to chloroformate or isocyanate respectively is within the range of from about 1:0.05 to 1:1.

* * * * *

UNITED STATES PATENT OFFICE
CERTIFICATE OF CORRECTION

PATENT NO. : 3,930,932
DATED : January 6, 1976
INVENTOR(S) : James Axel Christer Bjorklund et al It is certified that error appears in the above-identified patent and that said Letters Patent are hereby corrected as shown below:

In Claim 1, last line change "1:0.5" to

--- 1:0.05 ---.

Signed and Sealed this

Ninth Day of November 1976

[SEAL]

*Attest:*

RUTH C. MASON
*Attesting Officer*

C. MARSHALL DANN
*Commissioner of Patents and Trademarks*